US007682167B2

(12) United States Patent
Martin et al.

(10) Patent No.: US 7,682,167 B2
(45) Date of Patent: Mar. 23, 2010

(54) EXTERNAL GROUND CONNECTION FOR AN ELECTRICAL APPLIANCE

(75) Inventors: Greg Martin, Verona, WI (US); Melissa Cisewski, Madison, WI (US); Ron Austin, Madison, WI (US)

(73) Assignee: Wolf Appliance Company, Inc., Fitchburg, WI (US)

( * ) Notice: Subject to any disclaimer, the term of this patent is extended or adjusted under 35 U.S.C. 154(b) by 166 days.

(21) Appl. No.: 11/737,451

(22) Filed: Apr. 19, 2007

(65) Prior Publication Data

US 2008/0261419 A1 Oct. 23, 2008

(51) Int. Cl.
*H01R 13/648* (2006.01)

(52) U.S. Cl. ..... 439/95

(58) Field of Classification Search ..... 439/92, 439/855, 853, 858, 865, 881, 95, 97, 96
See application file for complete search history.

(56) References Cited

U.S. PATENT DOCUMENTS 4,557,537 A * 12/1985 Greer ..... 439/92
5,975,923 A * 11/1999 Chen ..... 439/95
6,106,310 A * 8/2000 Davis et al. ..... 439/95
6,790,092 B2 * 9/2004 Parsadayan et al. ..... 439/650
2007/0254504 A1 * 11/2007 Machadu et al. ..... 439/92

* cited by examiner

*Primary Examiner*—Edwin A. Leon
(74) *Attorney, Agent, or Firm*—Foley & Lardner LLP

(57) ABSTRACT

A grounding mechanism for an electrical appliance is provided. The electrical appliance includes an electrical plug configured for connection to an electrical ground, a chassis, an electrical component, and the grounding mechanism. The chassis is connected to the electrical plug to ground the chassis when the electrical plug is connected to the electrical ground. The grounding mechanism includes a conducting plate mounted to the chassis, a non-conducting fastener, and a grounding element. The conducting plate is in electrical contact with the electrical component to provide a ground to the electrical component. The non-conducting fastener mounts the conducting plate to the chassis such that the conducting plate is not in electrical contact with the chassis. The grounding element is mounted to the chassis from an exterior of the chassis to place the conducting plate in electrical contact with the chassis to provide the electrical ground to the electrical component.

24 Claims, 5 Drawing Sheets

EXTERNAL GROUND CONNECTION FOR AN ELECTRICAL APPLIANCE

FIELD

The subject of the disclosure relates generally to an external ground connection. More specifically, the disclosure relates to an external grounding mechanism for an electrical appliance such that an electrical component within the electrical appliance can easily be connected to and disconnected from an electrical ground.

BACKGROUND

As with many consumer products electrical appliances are subject to rules, regulations, and laws which attempt to ensure product quality and user safety. For example, UL 858 is a set of safety standards which apply to electrically operated household cooking appliances such as cooktops, ovens, stoves, ranges, etc. According to UL 858, a household cooking appliance must pass a high potential voltage test prior to being sold to a consumer. The high potential voltage test has to be conducted after the household cooking appliance is fully assembled. Unfortunately, implementing the high potential test can be problematic because many cooking appliances include electrical components which are designed to prevent voltages which fall in the range of the test.

For example, many modern cooking appliances include one or more metal oxide varistors (MOVs) on their power supplies to suppress high voltage transients which can occur during power surges, lightning storms, etc. To protect the cooking appliance and its user, the MOVs prevent high input voltages such as those in the range of the required high potential test. Cooking appliance manufacturers address this problem by disconnecting the MOVs from a constant earth ground to which the rest of the cooking appliance is connected. Without the constant earth ground, the MOVs are able to float such that an apparent voltage differential caused by the high potential input is minimal. In traditional cooking appliances, connecting and/or disconnecting the MOVs to the electrical ground requires that the cooking appliance be disassembled.

Thus, implementing a simple high potential test can require that the cooking appliance be assembled and disassembled multiple times. For example, the cooking appliance manufacturer has to fully assemble the cooking appliance with the MOV(s) disconnected perform the high potential test by sending a voltage through the electrical appliance, disassemble the cooking appliance, manually connect the MOV(s) to the electrical ground connected to the rest of the cooking appliance, and reassemble the cooking appliance, all prior to packaging the cooking appliance. This process is laborious and time consuming and results in lost revenue for the cooking appliance manufacturer, Thus, there is a need for an electrical appliance which includes an external grounding mechanism such that an MOV or other electrical component can be connected to and/or disconnected from an electrical ground without disassembling the electrical appliance.

SUMMARY

An exemplary grounding mechanism for an electrical appliance is provided. The grounding mechanism comprises a conducting plate capable of electrical contact with an electrical component of an electrical product. The grounding mechanism also comprises a non-conducting fastener capable of mounting the conducting plate to a chassis of the electrical product, and a grounding element capable of connection with the conducting plate from an exterior of the chassis to electrically ground the conducting plate to the chassis.

An exemplary electrical appliance is also provided. The electrical appliance comprises a chassis capable of being connected to an electrical ground, an electrical component, and a grounding mechanism The grounding mechanism comprises a conducting plate, a non-conducting spacer, a non-conducting fastener, and a grounding element The conducting plate is mounted to the chassis, and is in electrical contact with the electrical component. The non-conducting spacer is mounted between the chassis and the conducting plate such that the conducting plate is not in electrical contact with the chassis. The non-conducting fastener is capable of mounting the non-conducting spacer and the conducting plate to the chassis. The grounding element is capable of being inserted through the exterior of the chassis to place the conducting plate in electrical contact with the chassis.

An exemplary method of grounding an electrical component of an assembled electrical appliance is also provided. A chassis of an electrical appliance is connected to an electrical ground, and an electrical component of the electrical appliance is connected to a grounding mechanism. The grounding mechanism is not connected to the electrical ground. A high voltage is sent through the electrical appliance. After sending the high potential voltage through the electrical appliance, a grounding element is inserted from an exterior of the chassis to place the electrical component in electrical contact with the chassis.

Other principal features and advantages will become apparent to those skilled in the art upon review of the following drawings, the detailed description, and the appended claims.

BRIEF DESCRIPTION OF THE DRAWINGS

Exemplary embodiments will hereafter be described with reference to the accompanying drawings.

DETAILED DESCRIPTION

Figure 1:
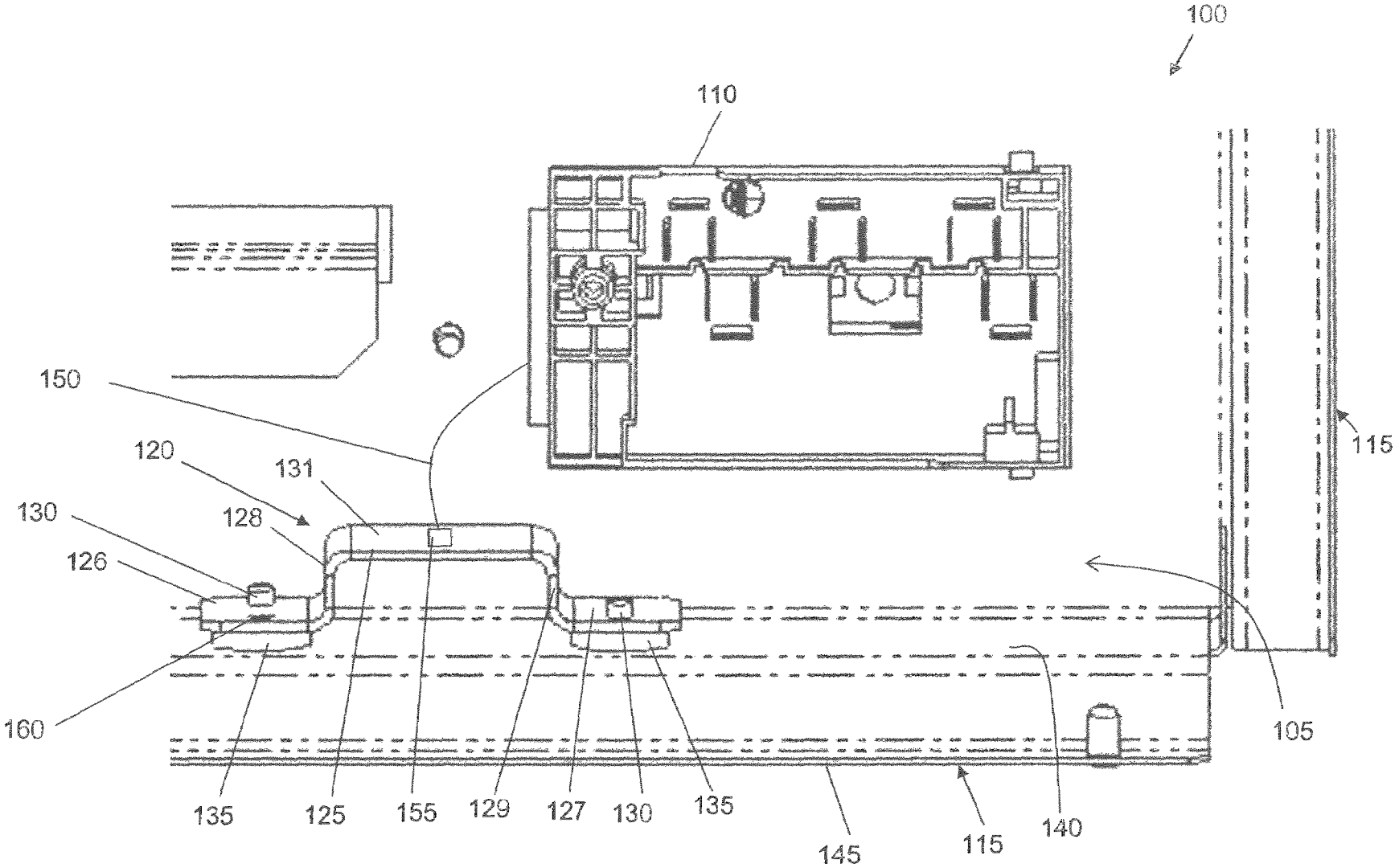
FIG. 1 is a partial top view of an electrical appliance in which an electrical component is disconnected from an electrical ground in accordance with an exemplary embodiment.

FIG. 1 is a partial top view of an electrical appliance 100 in which an electrical component 110 is disconnected from an electrical ground in accordance with an exemplary embodiment. Electrical appliance 100 can be any type of appliance or electrical product, including a cooking appliance, a washing machine, a dryer, a microwave, etc. Electrical appliance 100 includes a chassis 115 which forms a cavity 105 of electrical appliance 100. Chassis 115 can include any top walls of electrical appliance 100, any side walls of electrical appliance 100, any bottom walls of electrical appliance 100, and/or any legs or other support structure of electrical appliance 100. In an exemplary embodiment, chassis 115 can be constructed from an electrically conducting material.

Chassis 115 includes an interior 140 which faces toward cavity 105 and an exterior 145 which faces away from cavity 105. Exterior 145 is better illustrated with reference to FIGS. 3 and 4. In an exemplary embodiment, chassis 115 can be used to ground electrical appliance 100. An electrical ground can be connected to chassis 115 through a ground wire of an electrical plug of electrical appliance 100 For example, a third wire or a fourth wire within (or extending from) a standard electrical plug can provide the electrical ground as known to those skilled in the art. Alternatively, the electrical ground can be connected to chassis 115 through a ground wire which is separate from the electrical plug. In an alternative embodiment, the electrical ground can be connected to chassis 115 by any other method known to those of skill in the art.

In an exemplary embodiment, electrical component 110 can be a circuit board. The circuit board can be any structure capable of supporting one or more individual electrical components such as metal oxide varistors, transistors, resistors, diodes, etc. Alternatively, electrical component 110 can be a power supply or other board which supports one or more individual electrical components. In another alternative embodiment, electrical component 110 can refer to any of the one or more individual electrical components regardless of their location. For example, electrical component 110 can be two metal oxide varistors located within the power supply and a single metal oxide varistor located on the circuit board. During day-to-day use of electrical appliance 100, electrical component 110 can be connected to the electrical ground to which the rest of electrical appliance 100 is connected, However, as discussed above, it is occasionally desirable to disconnect electrical component 110 from the electrical ground while electrical appliance 100 is fully assembled. In an exemplary embodiment, an external grounding mechanism 120 can be used to control whether electrical component 110 is connected to the electrical ground.

External grounding mechanism 120 includes a conducting bracket 125, non-conducting fasteners 130, and non-conducting spacers 135. In an exemplary embodiment, conducting bracket 125 can be constructed from any electrically conducting material known to those of skill in the art. In another exemplary embodiment, conducting bracket 125 can be a hat bracket as illustrated with reference to FIGS. 1 and 2. The hat bracket can help minimize the risk that a conducting wire 150 connected to electrical component 110 will inadvertently contact chassis 115. In an exemplary embodiment, the hat bracket includes a first surface 126 and a second surface 127 located in a first plane. First surface 126 and second surface 127 can each be capable of receiving one or more non-conducting fasteners 130 and resting on one or more non-conducting spacers 135 such that first surface 126 and second surface 127 can be mounted to chassis 115 without being in electrical contact with chassis 115. The hat bracket also includes a third surface 128 which is connected to first surface 126 and which lies in a second plane which is substantially perpendicular to the first plane. The hat bracket also includes a fourth surface 129 which is connected to second surface 127 and which lies in a third plane which is substantially perpendicular to the first plane. The hat bracket further includes a fifth surface 131 which is connected to third surface 128 and fourth surface 129 and which lies in a fourth plane which is substantially parallel to the first plane. Fifth surface 131 can also be capable of receiving conducting wire 150 or other contact such that the hat bracket is in electrical contact with electrical component 110.

Alternatively, conducting bracket 125 can be any other conducting mechanism of any shape which is capable of directly or indirectly conveying an electrical ground connection from chassis 115 to electrical component 110. For example, conducting bracket 125 can be a circular conducting plate, a square conducting plate a conducting plate of any other shape, a conducting wire, a cylindrical conducting cable, etc. Conducting bracket 125 also includes a grounding element aperture 160 which is capable of receiving a grounding element (not shown in FIG. 1). The grounding element can be used to electrically connect conducting bracket 125 to chassis 115 such that conducting bracket 125 and anything electrically connected thereto are connected to the electrical ground. The grounding element is described in more detail with reference to FIG. 2.

Non-conducting spacers 135 are positioned in between conducting bracket 125 and chassis 115 such that conducting bracket 125 is not in electrical contact with chassis 115. Non-conducting spacers 135 can be constructed out of any non-conducting material known to those of skill in the art. In an exemplary embodiment, a single non-conducting spacer can be used at each location of possible contact between conducting bracket 125 and chassis 115. For example, if conducting bracket 125 is a circular plate, a single non-conducting spacer can be placed between the circular plate and chassis 115. Alternatively, a plurality of non-conducting spacers 135 can be used at any location of possible contact.

Non-conducting fasteners 130 can be used to mount conducting bracket 125 and non-conducting spacers 135 to chassis 115. As used in this disclosure, the term "mount" can include join, unite, connect, associate, insert, hang, hold, affix, attach, fasten, bind, paste, secure, bolt, nail, glue, screw, rivet, solder, weld, and other like terms. In an exemplary embodiment, non-conducting fasteners 130 can pass through apertures or slots within conducting bracket 125, non-conducting spacers 135, and chassis 115. Non-conducting fasteners 130 can be constructed out of any non-conducting material known to those of skill in the art. In an exemplary embodiment, non-conducting fasteners 130 can be plastic rivets. Alternatively, non-conducting fasteners 130 can be screws, bolts, nails, staples, or any other type of fasteners known to those of skill in the art. In another exemplary embodiment, a single non-conducting fastener can be used at each location of possible contact between conducting bracket 125 and chassis 115. Alternatively, one or more non-conducting fasteners 130 can be used to secure any portion of conducting bracket 125. As a result of using non-conducting spacers 135 and non-conducting fasteners 130, conducting bracket 125 is electrically isolated from chassis 115 while being mounted to chassis.

In an exemplary embodiment, electrical component 110 is connected to conducting bracket 125 through a conducting wire 150. In an exemplary embodiment, conducting wire 150 can be constructed from any electrically conducting material known to those of skill in the art. If electrical component 110 is a circuit board housing a plurality of individual electrical components, conducting wire 150 can be electrically connected to the circuit board such that each of the plurality of individual electrical components is connected to conducting bracket 125. Alternatively conducting wire 150 can be directly connected to one or more individual electrical components. In one embodiment, a plurality of conducting wires can be used to connect a plurality of circuit boards and/or a plurality of individual electrical components to conducting bracket 125. In an alternative embodiment, electrical component 110 can be in direct contact with conducting bracket 125 such that conducting wire 150 may not be included.

Conducting wire 150 is mounted to conducting bracket 125 through a conducting bracket connector 155. Conducting bracket connector 155 can be a screw, a bolt, or any other fastener known to those of skill in the art. Alternatively, conducting bracket connector 155 can be solder, weld, glue, or any other type of fastening material. In an exemplary embodiment, conducting bracket connector 155 can be constructed from any electrically conducting material known to those of skill in the art. In another exemplary embodiment, conducting wire 150 can be connected to electrical component 110 by the same method used to connect conducting wire 150 to conducting bracket 125. Alternatively, conducting wire 150 can be connected to electrical component 110 by any other method known to those of skill in the art.

Figure 2:
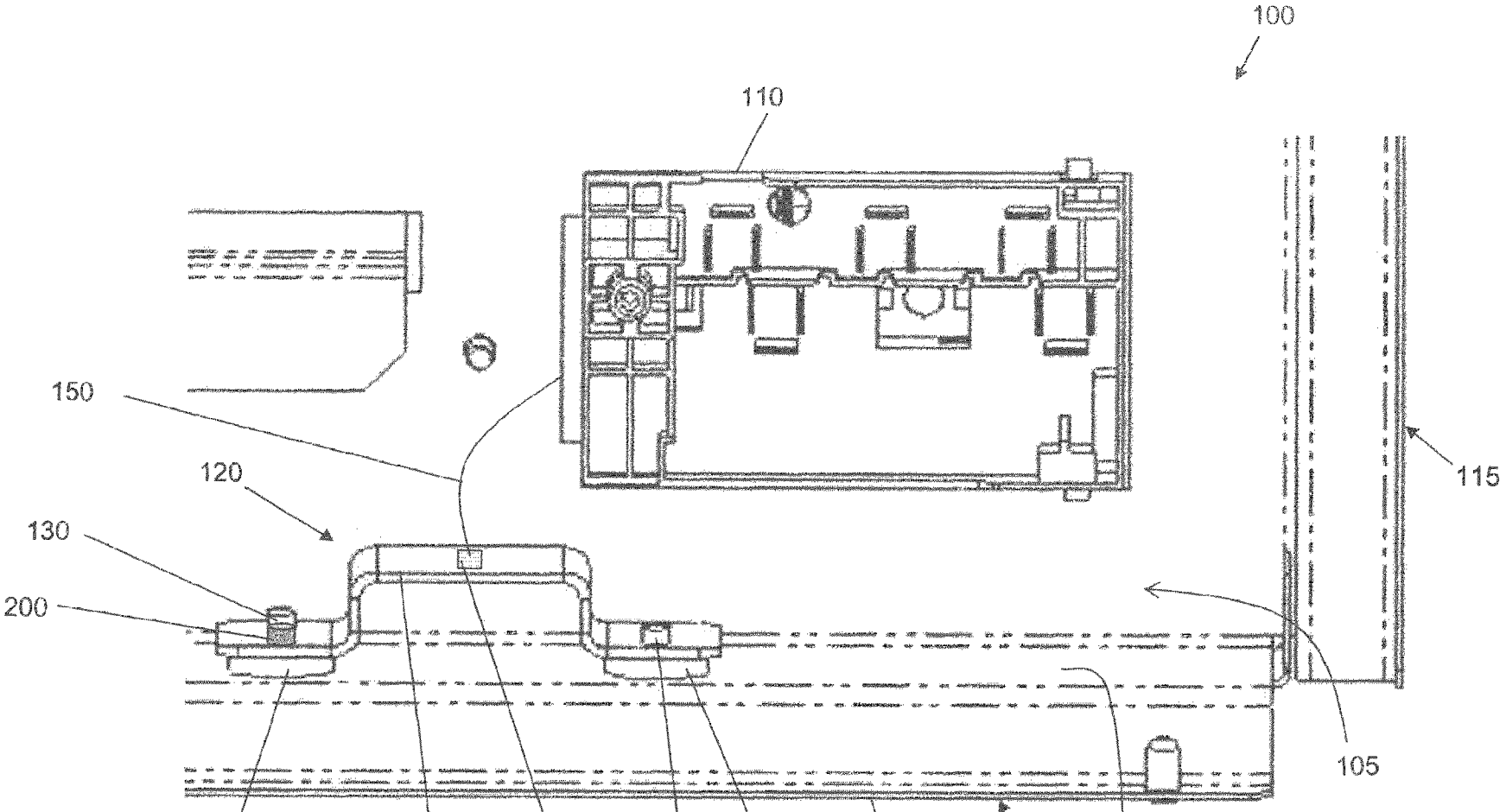
FIG. 2 is a partial top view of the electrical appliance in which the electrical component is connected to the electrical ground in accordance with an exemplary embodiment.

FIG. 2 is a partial top view of electrical appliance 100 in which electrical component 110 is connected to the electrical ground in accordance with an exemplary embodiment. In an exemplary embodiment a grounding element 200 is used to electrically connect conducting bracket 125 to chassis 115. Grounding element 200 can be constructed from any electrically conducting material known to those of skill in the art. In an exemplary embodiment, grounding element 200 can be inserted from exterior 145 of chassis 115, through an aperture 300 (illustrated with reference to FIG. 3) in chassis 115, and through one of the non-conducting spacers 135 such that grounding element 200 comes into electrical contact with conducting bracket 125. As a result, inserting grounding element 200 through chassis 115 causes conducting bracket 125 to be electrically connected to the electrical ground to which chassis 115 is connected. Similarly conducting bracket 125 causes conducting wire 150 to be electrically connected to the electrical ground, which in turn causes electrical component 110 to be electrically connected to the electrical ground. In one embodiment, electrical component 110 can be connected to one or more other electrical components such that a single grounding element 200 can be used to connect a plurality of electrical components to the electrical ground. Removing grounding element 200 results in electrical component 110 no longer being connected to the electrical ground to which chassis 115 is connected. In an exemplary embodiment, grounding element 200 can be inserted and/or removed while electrical appliance 100 is fully assembled.

In an exemplary embodiment, grounding element 200 can be a screw which mates with grounding element aperture 160 described with reference to FIG. 1. Alternatively, grounding element 200 can be a bolt, nail, rivet pin, rod, or any other element capable of being used to electrically connect chassis 115 to one or more electrical components. In one embodiment, grounding element 200 may include a locking mechanism such that grounding element 200 cannot be easily removed. The locking mechanism can be one or more locking washers, a thread sealant, a thread adhesive, or any other locking mechanism known to those of skill in the art. In an alternative embodiment, grounding element 200 may be permanently mounted to chassis 115 after the implementation of any testing which requires grounding element 200 to be absent. For example, grounding element 200 can be welded, soldered, glued, melted, etc. to chassis 115.

In an alternative embodiment, external grounding mechanism 120 may not include conducting bracket 125, non-conducting fasteners 1307 and/or non-conducting spacers 135. In such an embodiment, inserting grounding element 200 through chassis 115 can cause grounding element to come into direct electrical contact with one or more electrical components and/or one or more circuit boards. For example grounding element 200 can be a threaded bolt which can be received by a threaded aperture within a circuit board which is a given distance from chassis 115. In one embodiment, the circuit board can be electrically connected to other circuit boards and/or electrical components such that the electrical ground from chassis 115 can be provided to a plurality of circuit boards and/or electrical components by a single grounding element 200. In another alternative embodiment, a plurality of grounding elements can be used at distinct locations on chassis 115 to provide the electrical ground to various electrical components within electrical appliance 100. Any of the plurality of grounding elements can be used with or without conducting bracket 125 depending on the embodiment.

Figure 3:
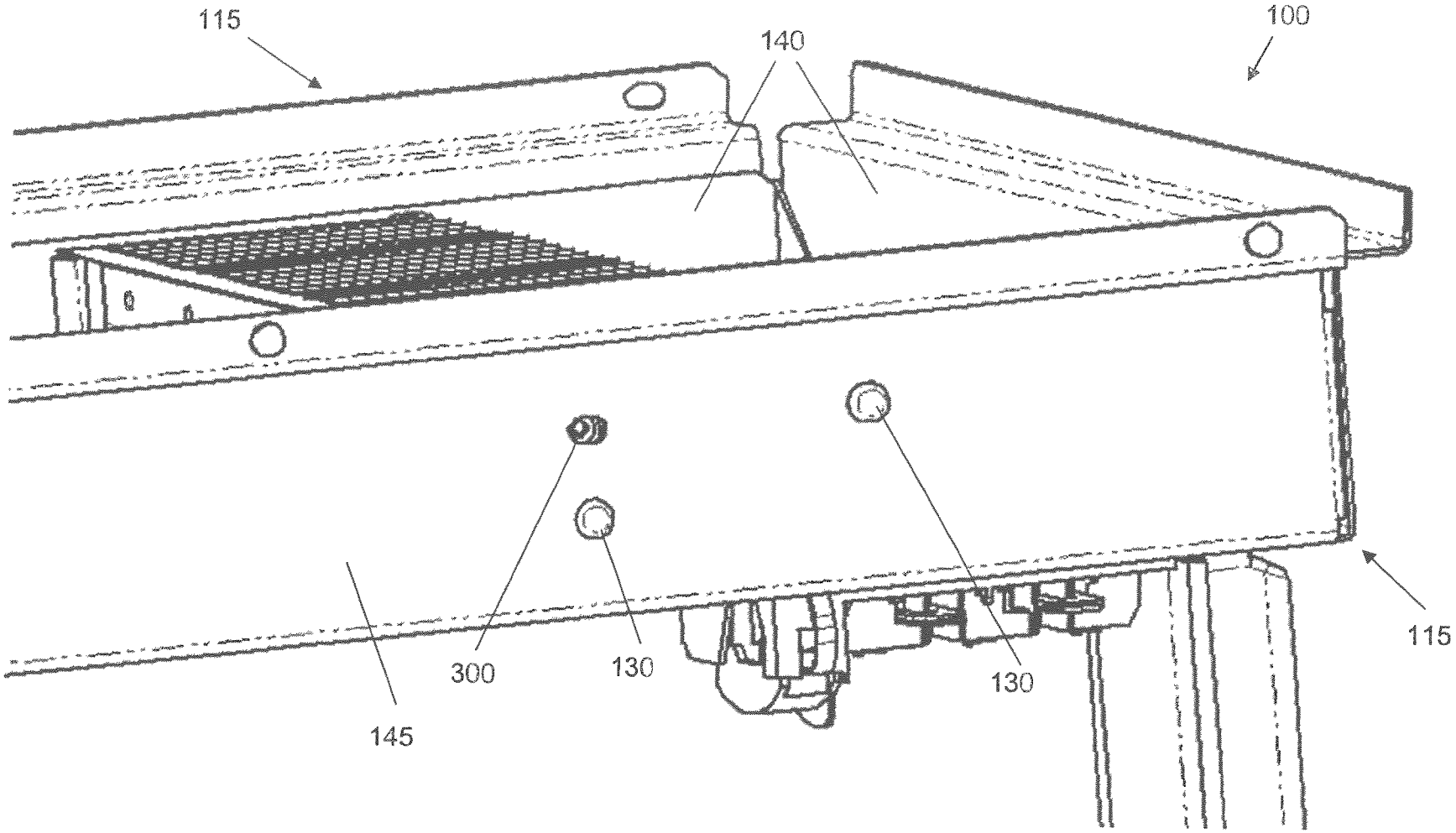
FIG. 3 is a side perspective view of the electrical appliance in which the grounding element is not inserted into the chassis in accordance with an exemplary embodiment
Figure 4:
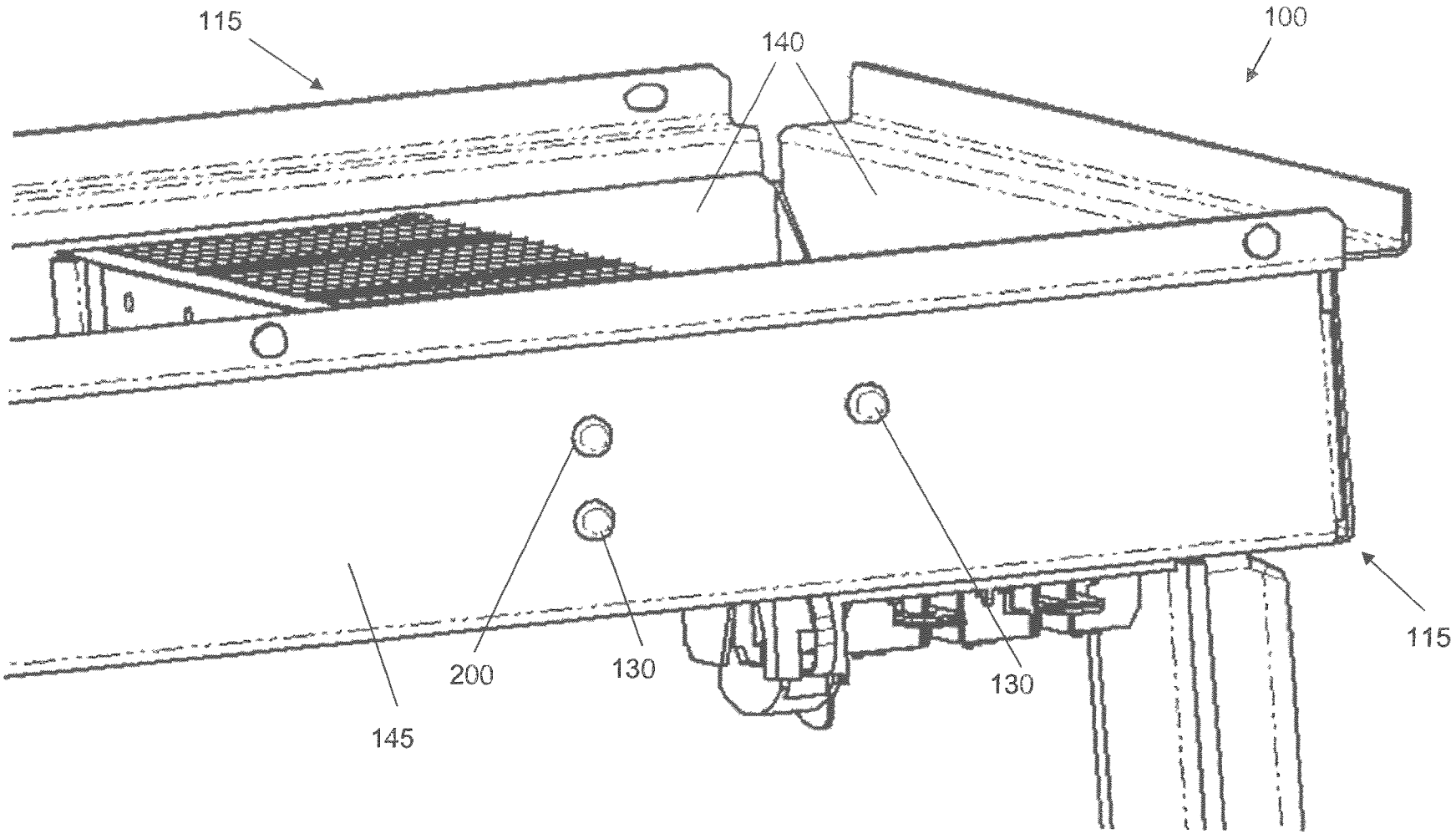
FIG. 4 is a side perspective view of the electrical appliance in which the grounding element has been inserted through the chassis in accordance with an exemplary embodiment.

FIG. 3 is a side perspective view of electrical appliance 100 in which grounding element 200 is not inserted into chassis 115 in accordance with an exemplary embodiment. An aperture 300 in chassis 115 is capable of receiving grounding element. In an exemplary embodiment, aperture 300 can extend from exterior 145 to interior 140 of chassis 115. Aperture 300 can be threaded or unthreaded depending on the embodiment. Also illustrated with reference to FIG. 3 are non-conducting fasteners 130 used to secure conducting bracket 125 to chassis 115. FIG. 4 is a side perspective view of electrical appliance 100 in which grounding element 200 has been inserted through chassis 115 in accordance with an exemplary embodiment.

Figure 5:
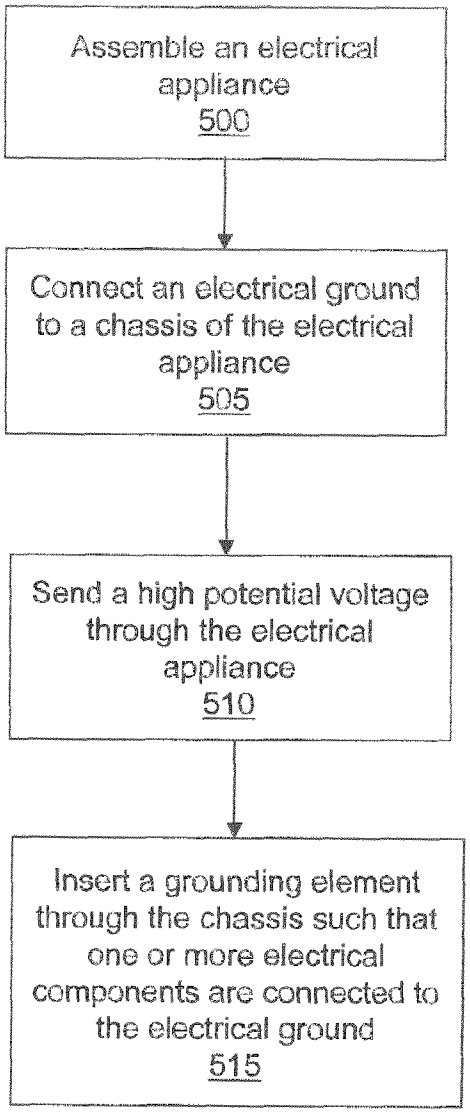
FIG. 5 is a flow diagram illustrating operations performed during a high potential test of an electrical appliance in accordance with an exemplary embodiment.

FIG. 5 is a flow diagram illustrating operations performed during a high potential test of an electrical appliance in accordance with an exemplary embodiment. Additional, fewer, or different operations may be performed in alternative embodiments. In an operation 500, the electrical appliance is assembled. The electrical appliance can be assembled by any method known to those of skill in the art. In an operation 505, an electrical ground is connected to a chassis of the electrical appliance. The electrical ground can be connected to the chassis through an electrical plug, or any other method known to those of skill in the art. In an exemplary embodiment, the electrical appliance includes one or more electrical components which are not in electrical contact with the chassis such that the one or more electrical components are not connected to the electrical ground. The one or more electrical components can be metal oxide varistors (MOVS) or other electrical safety components which are designed to prevent large voltage inputs to the electrical appliance. Alternatively, the one or more electrical components can be any other type of electrical components.

In an operation 510, a high potential voltage is sent through the electrical appliance. In an exemplary embodiment, the high potential voltage can be the voltage required by UL 858 section 75, table 75.1, which states that the high potential voltage can be achieved by either 1000 Vac for 60 seconds or 1200 Vac for 1 second. Alternatively, the high potential voltage can be any other voltage used to test the quality and/or safety of the electrical appliance. In another exemplary embodiment, the one or more electrical components do not prevent the high potential voltage because the one or more electrical components are not connected to a constant electrical ground. The electrical ground of the one or more electrical components can be a floating ground such that an apparent voltage differential caused by the high potential voltage does not exceed any high voltage thresholds of the one or more electrical components.

In an operation 515, a grounding element is inserted through the chassis such that the one or more electrical components are connected to the electrical ground. In an exemplary embodiment, the grounding element can be inserted through the chassis and into a conducting bracket which is separated from the chassis by one or more non-conducting spacers. The conducting bracket can be in contact with the one or more electrical components directly or through a conducting wire or other conduit. As a result, the one or more electrical components are connected to the electrical ground without disassembling the electrical appliance.

One or more flow diagrams have been used herein to describe exemplary embodiments. The use of flow diagrams is not meant to be limiting with respect to the order of operations performed. Further, for the purposes of this disclosure and unless otherwise specified, "a" or "an" means "one or more."

The foregoing description of exemplary embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An electrical appliance comprising:

an electrical plug configured for connection to an electrical ground;

a chassis connected to the electrical plug through a first grounding mechanism to ground the chassis when the electrical plug is connected to the electrical ground;

an electrical component; and a second grounding mechanism different from the first grounding mechanism, the second grounding mechanism comprising a conducting plate, wherein the conducting plate is in electrical contact with the electrical component to provide a ground to the electrical component;

a non-conducting spacer mounting the conducting plate to the chassis such that the conducting plate is not in electrical contact with the chassis; and a grounding element mounted to the chassis from an exterior of the chassis to place the conducting plate in electrical contact with the chassis to provide the electrical ground to the electrical component.

2. The electrical appliance of claim 1, wherein the grounding element comprises a screw or a bolt.

3. The electrical appliance of claim 1, wherein the electrical component comprises a circuit board.

4. The electrical appliance of claim 1, wherein the electrical component is mounted within an interior cavity of the chassis.

5. The electrical appliance of claim 1, wherein the electrical component comprises a metal oxide varistor.

6. The electrical appliance of claim 1, wherein the electrical appliance comprises a cooking appliance.

7. The electrical appliance of claim 1, wherein the grounding element is further configured for movement to disconnect the electrical contact between the conducting plate and the chassis to disconnect the electrical ground from the electrical component.

8. The electrical appliance of claim 1, further comprising a non-conducting fastener mounting the conducting plate to the chassis.

9. The electrical appliance of claim 1, further comprising a conducting wire connected between the conducting plate and the electrical component to provide the ground to the electrical component.

10. The electrical appliance of claim 9, further comprising a conducting plate connector connecting the conducting wire to the conducting plate.

11. The electrical appliance of claim 1, wherein the electrical component comprises an electrical safety component configured to prevent a high voltage input from damaging the electrical appliance.

12. The electrical appliance of claim 11, wherein the electrical component comprises a metal oxide varistor.

13. The electrical appliance of claim 1, wherein the conducting plate comprises a conducting bracket.

14. The electrical appliance of claim 13, wherein the conducting bracket comprises a hat bracket.

15. The electrical appliance of claim 1, wherein the chassis comprises an aperture configured to receive the grounding element.

16. The electrical appliance of claim 15, wherein the aperture is threaded.

17. A method of grounding an electrical component of an assembled electrical appliance, the method comprising:

connecting a chassis of an electrical appliance to an electrical ground;

connecting an electrical component of the electrical appliance to a grounding mechanism;

after connecting the electrical component to the grounding mechanism and without connecting the grounding mechanism to the electrical ground, sending a high voltage through the electrical appliance; and after sending the high voltage through the electrical appliance, connecting, from an exterior of the chassis, a grounding element to the grounding mechanism to place the electrical component in electrical contact with the chassis to provide the electrical ground to the electrical component.

18. The method of claim 17, further comprising assembling the electrical appliance.

19. The method of claim 17, wherein the grounding mechanism comprises:

a conducting plate in electrical contact with the electrical component to provide a ground to the electrical component; and a non-conducting fastener mounting the conducting plate to the chassis such that the conducting plate is not in electrical contact with the chassis.

20. The method of claim 17, wherein the high voltage comprises a voltage greater than 1000 volts alternating current.

21. The method of claim 17, wherein the grounding mechanism comprises:

a conducting plate in electrical contact with the electrical component to provide a ground to the electrical component; and a non-conducting spacer mounted between the chassis and the conducting plate such that the conducting plate is not in electrical contact with the chassis.

22. The method of claim 17, wherein the conducting plate comprises a hat bracket.

23. The method of claim 17, wherein the chassis comprises an aperture configured to receive the grounding element.

24. The method of claim 17, further comprising mounting the electrical component within an interior cavity of the chassis before connecting the electrical component of the electrical appliance to the grounding mechanism.

* * * * *